US005128501A

United States Patent [19]

Bilbao Urouiola

[11] Patent Number: 5,128,501

[45] Date of Patent: Jul. 7, 1992

[54] IRON STAND CONNECTOR

[75] Inventor: Maria G. Bilbao Urouiola, Guecho, Spain

[73] Assignee: Officina de Investigacion Agrupada, S.A., Guipuzcoa, Spain

[21] Appl. No.: 647,553

[22] Filed: Jan. 29, 1991

[30] Foreign Application Priority Data

Jan. 29, 1990 [ES] Spain ..... 9000240

[51] Int. Cl.[5] ..... H01H 33/96; H01H 1/24

[52] U.S. Cl. ..... 200/51.09; 200/246; 200/247; 439/188; 439/137

[58] Field of Search ..... 200/51.09, 51.02, 51.10, 200/51.11, 246, 247; 439/137, 139, 136, 188, 374

[56] References Cited

U.S. PATENT DOCUMENTS 896,838 8/1908 Klein ..... 200/51.09

4,719,334 1/1988 Rebel ..... 200/51.09

FOREIGN PATENT DOCUMENTS 99574 4/1925 Austria ..... 200/51.09

466205 5/1937 United Kingdom ..... 200/51.09

*Primary Examiner*—Renee S. Luebke

*Assistant Examiner*—David J. Walczak

*Attorney, Agent, or Firm*—Helfgott & Karas

[57] ABSTRACT

An iron stand connector includes a body in which two movable elements are provided, upon which the connecting terminals of the iron impinge. Each movable element has a vertical middle section and two end sections which have right-angled bends and are positioned opposite each other. The lower end section is fitted with a silver connection. Both end sections are provided with holes, through which two respective rods pass, acting as guides for a vertical displacement of each movable element.

3 Claims, 1 Drawing Sheet

IRON STAND CONNECTOR

FIELD OF THE INVENTION

The present invention relates to an iron stand connector, namely for the so-called "cable-less" irons, where the main lead is connected to a stand, fitted with the connector, for the iron to be heated when not is use and lying on the stand.

BACKGROUND TO THE INVENTION

This type of connectors is designed to expedite clothes ironing, since the iron is not directly provided with the main lead and can be handled more easily, for there is not risk of the cable becoming entangled and hindering ironing. However, this type of connector must meet certain requirements, for instance that the loop should not be damaged after the connector has been plugged in and out many times. Moreover, when the iron is not coupled to the stand, the user should be in no danger from electric shocks due to accidentally touching the elements under electric power.

Obviously, since the electrical output of irons of this kind is roughly 1,200 to 1,800 watts, the electric connection cannot possibly take place by merely plugging the iron's terminals or pins into the connector's socket terminals, because this would lead to strong short-circuit currents at such terminals and would rapidly deteriorate the same.

More or less complex solutions exist to solve these problems which essentially involve constructing the connector in the form of closed bodies, the lower part of which has been fitted with terminal strips for the connection the main lead and the top base of which has been fitted with holes which dimensionally and positionally coincided with the iron's connecting plug terminals. The holes were usually closed by means of a hinged cap or like element, so that it was almost impossible for the user to accidentally touch the electrical conductors inside the closed body.

As to the device arranged inside the connectors to prevent the aforesaid loop through the iron's actual connectors or terminals, various solutions were proposed of which one was disclosed in Spanish utility model application 8802926 which shows at least two pairs of connection elements, one for each of the iron's phases, and optionally another one for earth, such elements being elastic and provided with silver connections so that in each pair when the set is at rest, the silver connections are separated, whereas when the iron's plug is inserted, each of such plug's terminals impinges first of all upon one of such elements, without forming any loop, elastically deforming the same until it touches the other element, whereupon the circuit is connected through the silver contacts.

The above-described solution, which is perfectly acceptable theoretically poses functional problems in practice, since repeated bending of the mobile connection elements finally causes the same to break, and at best, permanently deforms the same, with the silver connections being permanently looped, both when the connector is in operative and non-operative condition, and therefore the connector is no longer functional and there is, in fact a loop formed through the iron's plug pins.

SUMMARY OF THE INVENTION

It is an object of the present invention to provide an iron stand connector subject which fully solves the above problems.

The iron stand connector is of the type disclosed in the aforesaid Spanish utility model application 8802926, which is triggered by the respective iron's plug terminal, not by elastic deformation, but by total duly guided displacement against a spring.

More specifically, each movable element has two end, counterposed right-angled bends formed in such a manner that the one closest to the upper base or body cover will be duly driven by the respective pin, while the other one is naturally fitted with a platinum connection, these two end portions having two holes through which the element travels duly guided on two rods which project at a right angle from the bottom of the body, for each of the movable elements with the recoil spring mounted on one of the rods.

Furthermore, in an embodiment of the invention, the upper right-angled bend of the connection element is provided with a fold which allows the respective pin to impinge upon the element at its vertical and middle portions, without impairing a suitable electric connection on the same.

In according with another embodiment of the invention, the upper end of each of the insulating rods, on which the springs are mounted are moreover conveniently provided with an auxiliary element having a large surface to act as a radiator or heat sink while the iron is plugged off, when the break arc causes the movable elements to be heated up considerably, which the connection elements, when the plugging off is over, contact the respective auxiliary elements and are assisted by these latter in carrying away the heat.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

DESCRIPTION OF THE PREFERRED EMBODIMENT OF THE INVENTION

Figure 1:
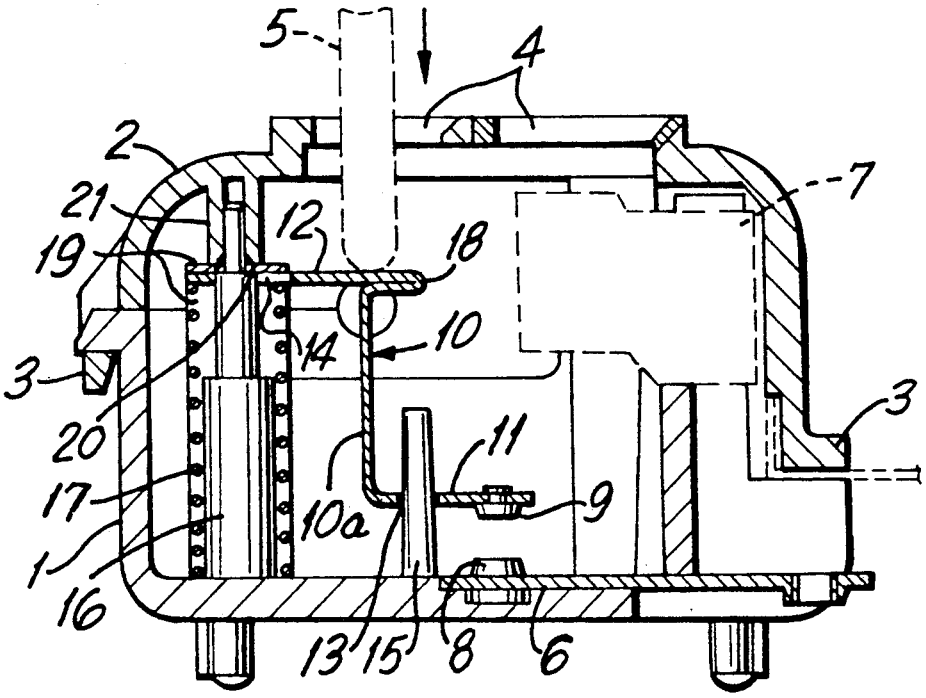
FIG. 1 is a side elevation and sectional view of an iron stand connector according to the invention.
Figure 2:
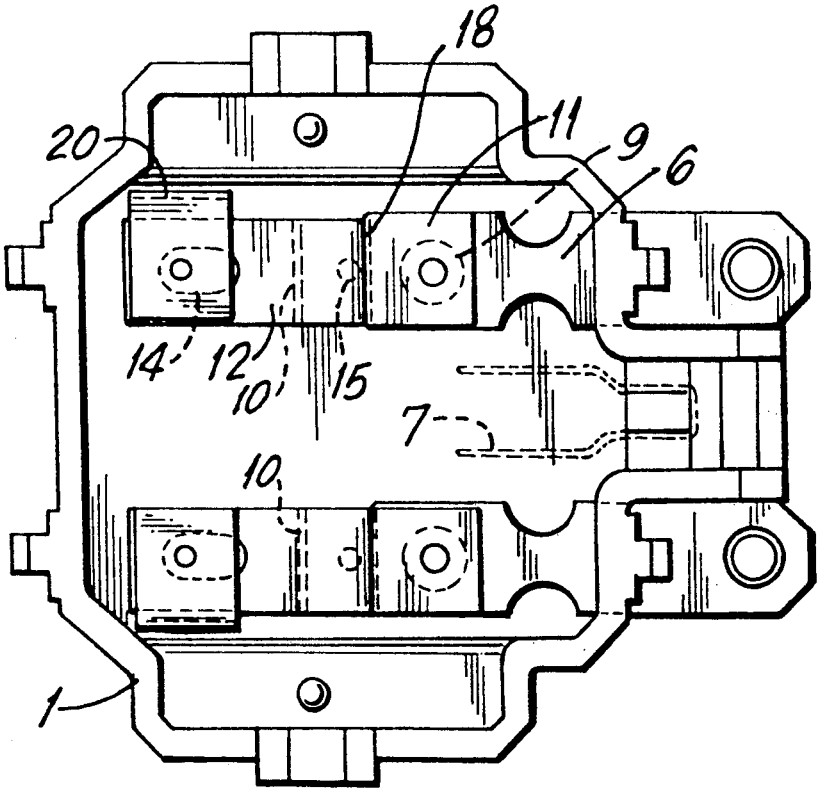
FIG. 2 is a plan view of the same connector, without the cover over its body.

In the light of FIGS. 1 and 2, it can be seen that the iron stand connector comprises a housing including a body (1) and a cover (2) provided with appropriate closing means (3). The cover has necessary holes (4), through which connecting terminals (5) of the iron are inserted, while the bottom of body (1), and suitably accessible from the outside, is provided with power supply terminal strips (6) for each of the iron's phases, as well as an earth connection (7). Each terminal strip (6) is capped by a silver or like connection (8), complementing another connection (9) connected to respective movable elements (10) upon which the connecting terminals (5) to the iron impinge.

According to the present invention each of the movable strip-like elements (10) has a vertical middle section denoted at (10*a*), and two counterposed end sections (11) and (12) with right-angled bends, one of which, specifically the lower one (11), is fitted with the respective silver connection (9). The two end sections (11) and (12) are provided with respective holes (13) and (14) through which two heat insulating rods (15) and (16) pass, projecting straight from the bottom of body (1) and acting as guides for a vertical displacement of each element (10), which displacement takes place against a spring (17) which coaxially surrounds the rod (16).

According to a further feature of the invention, each movable element (10) is provided with a fold (18) at its top bent section (12) in order to permit the pin (5) or the iron to impinge upon the movable element (10) at a flat and stable area. Such impingement takes place in line with the middle section (10*a*) of the element 10, as clearly shown in FIG. 1, to allow the latter to be dragged without being deformed and without any risk for the connection to be broken.

In accordance with yet another feature of the invention, an auxiliary element (19) having a large surface is mounted at the upper end of each rod (16), preferably sideways of such rod, as can be seen in either of the figures. The auxiliary element (19) is also in contact with movable element (10), after each disconnection and, as can also be seen in FIG. 1, the auxiliary element (19) acts as a radiator in conjunction with movable elements (10) to carry away heat generated by a break arc during such disconnection.

More specifically, each element (19) rests upon a stepping (20) provided on the respective rod (16) and is held against the same by a neck-like portion (21) which inwardly projects from the inner side of cover (2) and receives the upper end of each rod (16).

Thus, the connector is absolutely reliable, and the useful life of movable elements (10) is just about endless, since such elements at no time deformed and are moreover considerably assist in carrying away heat generated by strong break currents.

It appears that the device has been herein described at sufficient length for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. An iron stand connector, comprising a housing including a body and an insulating cover attached to each other, said cover being provided with holes for insertion of terminal connecting pins of an iron into said housing, two vertically movable elements positioned in said housing and acting as connecting bridges between said pins and terminal strips connected to a mains lead, each movable element including a middle section extending at a right angle to a bottom of said body and two counterposed end sections bent at right angles to said middle section, a lower one of said end section being fitted with a respective silver connection facing a respective terminal strip, two rods provided in said housing for each movable element, said rods upwardly projecting from said bottom of said body, one of said rods being longer than another, and a spring mounted coaxially on said longer rod, each of said end sections being provided with two holes receiving said two rods, respectively, such that said rods act as guides for the respective movable element which is moved by a respective terminal connecting pin against said spring to effect a bridge connection between said pin and a respective terminal strip.

2. The iron stand connector according to claim 1, wherein said middle section has a fold at a joint thereof with an upper end section, said fold receiving the respective terminal connecting pin so that said terminal connecting pin impinges upon the associated movable element perfectly in line with said middle section thereof but at a distance from an internal edge of said upper end section.

3. The iron stand connector according to claim 2, wherein each of said longer rods extends beyond said movable element and receives an auxiliary member having a large surface which the movable element contacts when a connection is broken and which acts as a radiator to carry away heat generated by a break arc, each of said longer rods having a stepping, said cover including two neck portions projecting inwardly of said housing, said auxiliary member being stabilized against the stepping of a respective longer rod by means of a respective neck portion receiving an upper end of the respective longer rod.

* * * * *